US005862940A

United States Patent [19]

Chism et al.

[11] Patent Number: 5,862,940

[45] Date of Patent: Jan. 26, 1999

[54] EXPANDABLE DISPOSABLE GASOLINE CONTAINER AND METHOD

[76] Inventors: Jay J. Chism; Don Gillette, both of 714 Val Sereno Dr., Encinitas, Calif. 92024

[21] Appl. No.: 886,340

[22] Filed: Jul. 1, 1997

[51] Int. Cl.[6] ..... B65D 37/00

[52] U.S. Cl. ..... 220/666; 220/768

[58] Field of Search ..... 220/666, 768, 220/769, 904, 905, 755

[56] References Cited

U.S. PATENT DOCUMENTS

| | | | |
|---|---|---|---|
| 2,950,029 | 8/1960 | Winstead | 222/143 |
| 3,083,877 | 4/1963 | Gash | 222/107 |
| 3,156,383 | 11/1964 | Melli | 222/83 |
| 3,248,002 | 4/1966 | Song | 220/755 X |
| 3,268,112 | 8/1966 | Croce | 220/768 |
| 3,580,427 | 5/1971 | Clarke | 222/215 |
| 4,492,313 | 1/1985 | Touzani | 215/1 |
| 4,921,147 | 5/1990 | Poirier | 220/666 X |
| 5,158,123 | 10/1992 | Senko | 220/666 X |
| 5,447,110 | 9/1995 | Brown | 220/666 X |

*Primary Examiner*—Steven M. Pollard
*Attorney, Agent, or Firm*—Townsend and Townsend and Crew

[57] ABSTRACT

A method for adding gasoline to a gasoline tank of a motor vehicle. The method employs expandable hollow gasoline container having a top and a base. Accordion pleaded walls are coupled to the top and to the base. The expandable gasoline container also includes an expandable orifice member; a cylindrical conduit connected to the top where through gasoline is added to fill the gasoline container; and a handle assembly engaged to the cylindrical conduit.

20 Claims, 10 Drawing Sheets

EXPANDABLE DISPOSABLE GASOLINE CONTAINER AND METHOD

BACKGROUND OF THE INVENTION

1. Field of the Invention

The present invention is related to a disposable expandable gasoline container. More specifically, the present invention provides a disposable expandable container that is dimensioned to fit in the glove compartment (or trunk) of a motor vehicle and a method for adding a liquid hydrocarbon (e.g. gasoline) to the motor vehicle after the motor vehicle has indicated a need for the liquid hydrocarbon.

2. Description of the Prior Art

Portable gasoline containers are designed to be carried by hand and to be used to transport gasoline from distribution points to use point. The gasoline containers need a pouring vent to enable the free entry of air to replace the gasoline being poured out. Conventional portable gasoline containers typically include a spout where through the gasoline can be dispensed.

Conventional portable containers are bulky and can not fit in a glove compartment of a motor vehicle and/or are not suitable for storing, transporting and dispensing gasoline. Printed and published prior art does not provide a solution to these problems, as shown in the following U.S. Patents which were discovered in a patentability investigation: U.S. Pat. No. 2,950,029 to Winstead; U.S. Pat. No. 3,083,877 to Gash; U.S. Pat. No. 3,156,383 to Melli; U.S. Pat. No. 3,580,427 to Clarke; and U.S. Pat. No. 4,492,313 to Touzani.

U.S. Pat. No. 2,950,029 to Winstead teaches a substantially cubical container which is diagonally collapsible in order to provide the necessary draft for nesting purposes. The container is described as preferably being formed of a thermal plastic material, such as polyethylene.

U.S. Pat. No. 3,083,877 to Gash teaches a collapsible container with corrugated sides in order to collapse the container in an accordion like manner.

U.S. Pat. No. 3,156,383 to Melli teaches an expandable container which is primarily for a single use purpose. The container is intended particularly to hold materials such as sodium hypochlorite or any other type of material that would prevent the container from being reused.

U.S. Pat. No. 3,580,427 to Clarke teaches a container having pleated walls with a lip type opening in order to dispense cream products, such as soaps, shaving creams, etc.

U.S. Pat. No. 4,492,313 to Touzani teaches a collapsible plastic bottle of circular bellows like configuration. The bellows fold to retain the folded condition without external assistance.

Therefore, what is needed and what has been invented is a disposable expandable container that is capable of being stored in a glove compartment or trunk of a motor vehicle and capable of being expanded to be filled with gasoline in the event that the motor vehicle runs out of gasoline.

SUMMARY OF THE INVENTION

The present invention accomplishes its desired objects by broadly providing a disposable expandable gasoline container comprising a generally planar base; a pair of base side walls bound to the base; and a pair of base end walls secured to the base and to the base side walls. A generally planar top is provided with a vent opening and a generally central opening. A pair of accordion pleated sidewalls is secured to the top and to the base side walls; and a pair of accordion pleated end walls is secured to the accordion pleated sidewalls and to the base end walls and to the top. The gasoline container further includes an expandable orifice member secured to and extending through one of the base side walls; and a cylindrical conduit connected to the top and axially aligned with the generally central opening. A handle assembly is engaged to the cylindrical conduit.

The present invention also accomplishes its desired objects by broadly providing a method for adding gasoline to a gasoline tank of a motor vehicle comprising the steps of:

(a) providing a motor vehicle having a glove compartment or trunk and a gas tank;

(b) disposing in the glove compartment or trunk an expandable hollow gasoline container including an orifice assembly;

(c) removing the gasoline container from the glove compartment or trunk of step (b);

(d) expanding the removed gasoline container;

(e) adding gasoline into the expanded gasoline container;

(f) expanding the orifice assembly; and (g) pouring gasoline from the gasoline container, through the expanded orifice assembly and into the gas tank of a motor vehicle.

It is therefore an object of the present invention to provide a disposable expandable gasoline container.

It is another object of the present invention to provide a method for adding a gasoline tank of a motor vehicle.

These, together with the various ancillary objects and features which will become apparent to those skilled in the art as the following description proceeds, are attained by this novel gasoline container and method, a preferred embodiment thereof shown with reference to the accompanying drawings, by way of example only, wherein:

DETAILED DESCRIPTION OF THE INVENTION

Figure 1:
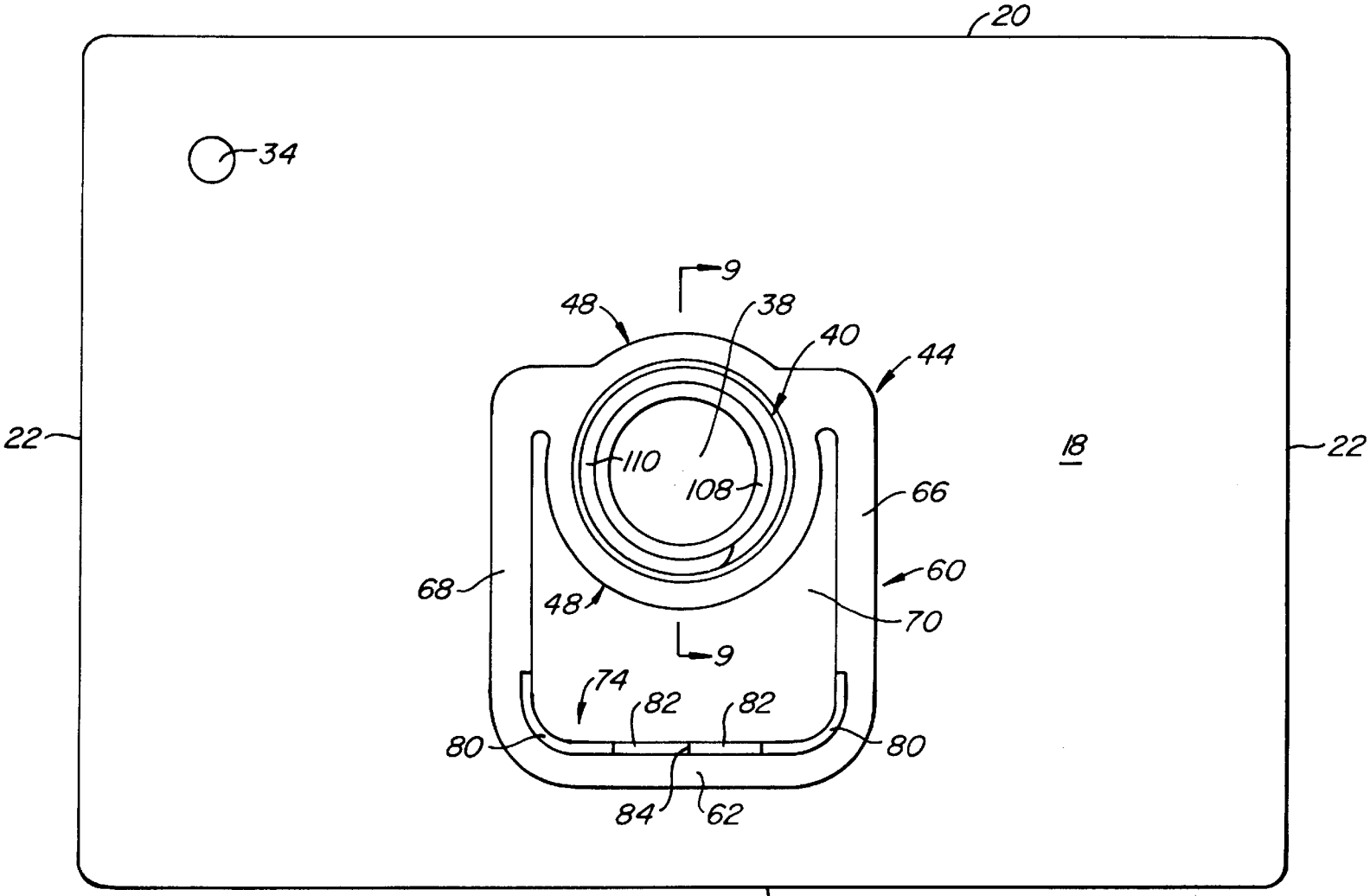
FIG. 1 is a top plan view of the expandable hollow gasoline container of the present invention.

Referring in detail now to the drawings wherein similar parts of the invention are identified by like reference numerals, there is seen an expandable, hollow container, generally illustrated as 10. The container 10 includes a generally planar bottom or base 12, a pair of upright side walls 14—14 bound to the base 12, and a pair of upright end walls 16—16 secured to the base 12 and to the side walls 14—14. The container 10 also includes a generally planar top 18, and accordion pleated, corrugated sidewalls 20—20 bound to accordion pleated, corrugated end walls 22—22. The corrugated sidewalls 20—20 and end walls 22—22 are secured to the top 18 and to the side walls 14—14 and the end walls 16—16 respectively. The accordion pleated, corrugated sidewalls 20—20 and end walls 22—22 respectively include fold lines 26 and 28.

Figure 2:
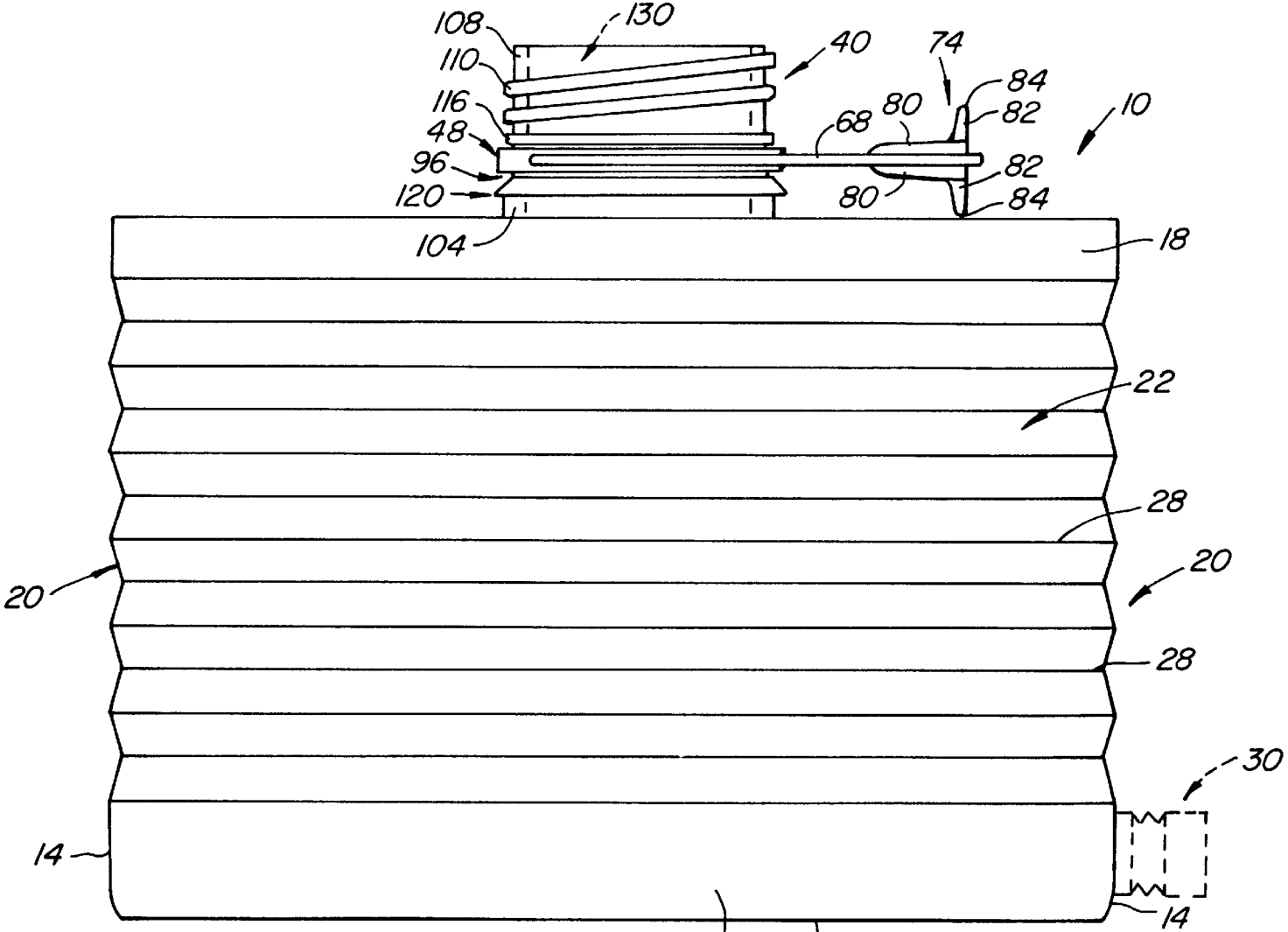
FIG. 2 is an end elevational view of the expandable hollow gasoline container of FIG. 1.
Figure 3:
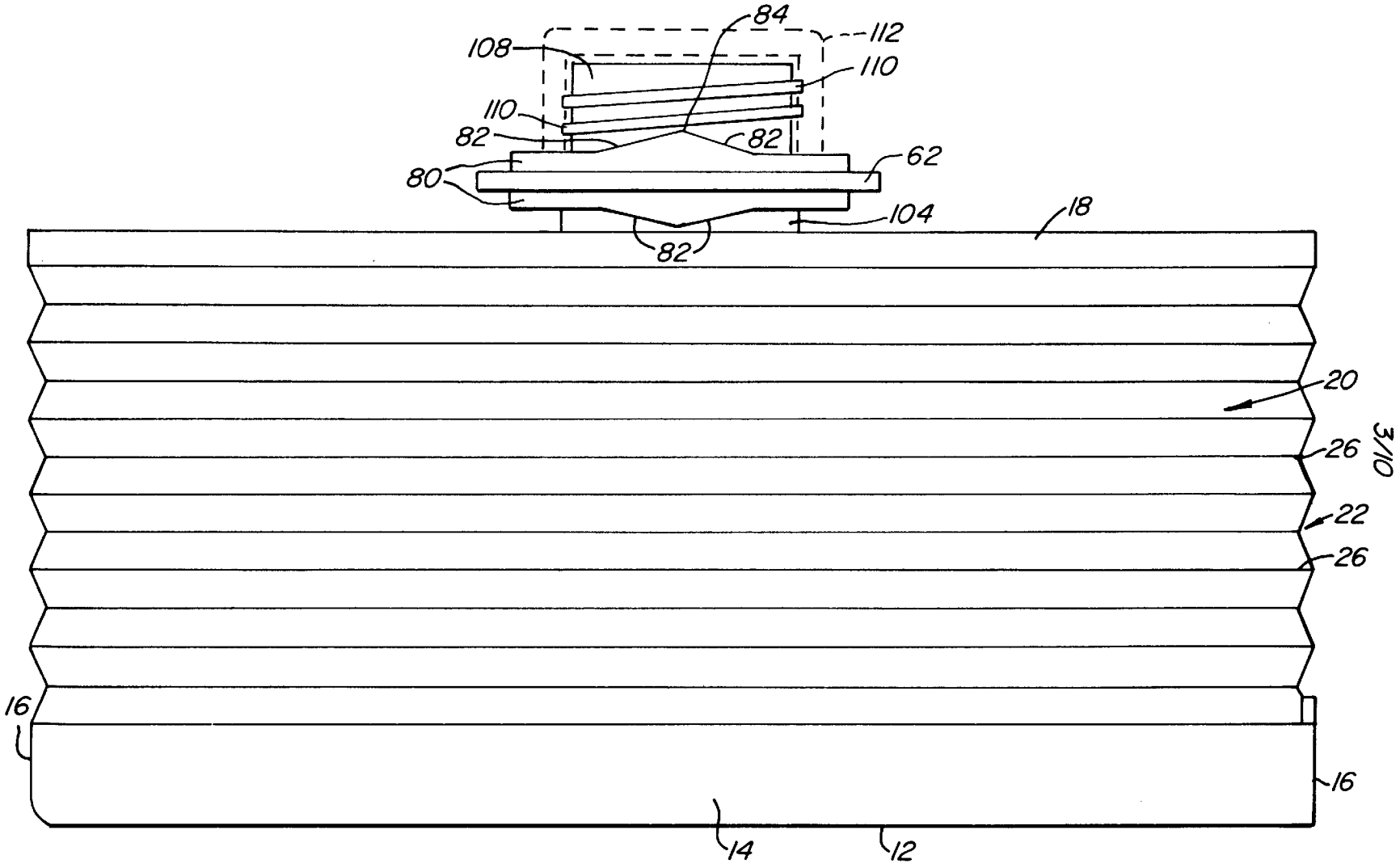
FIG. 3 is a side elevational view of the expandable hollow gasoline container of FIG. 1.
Figure 4:
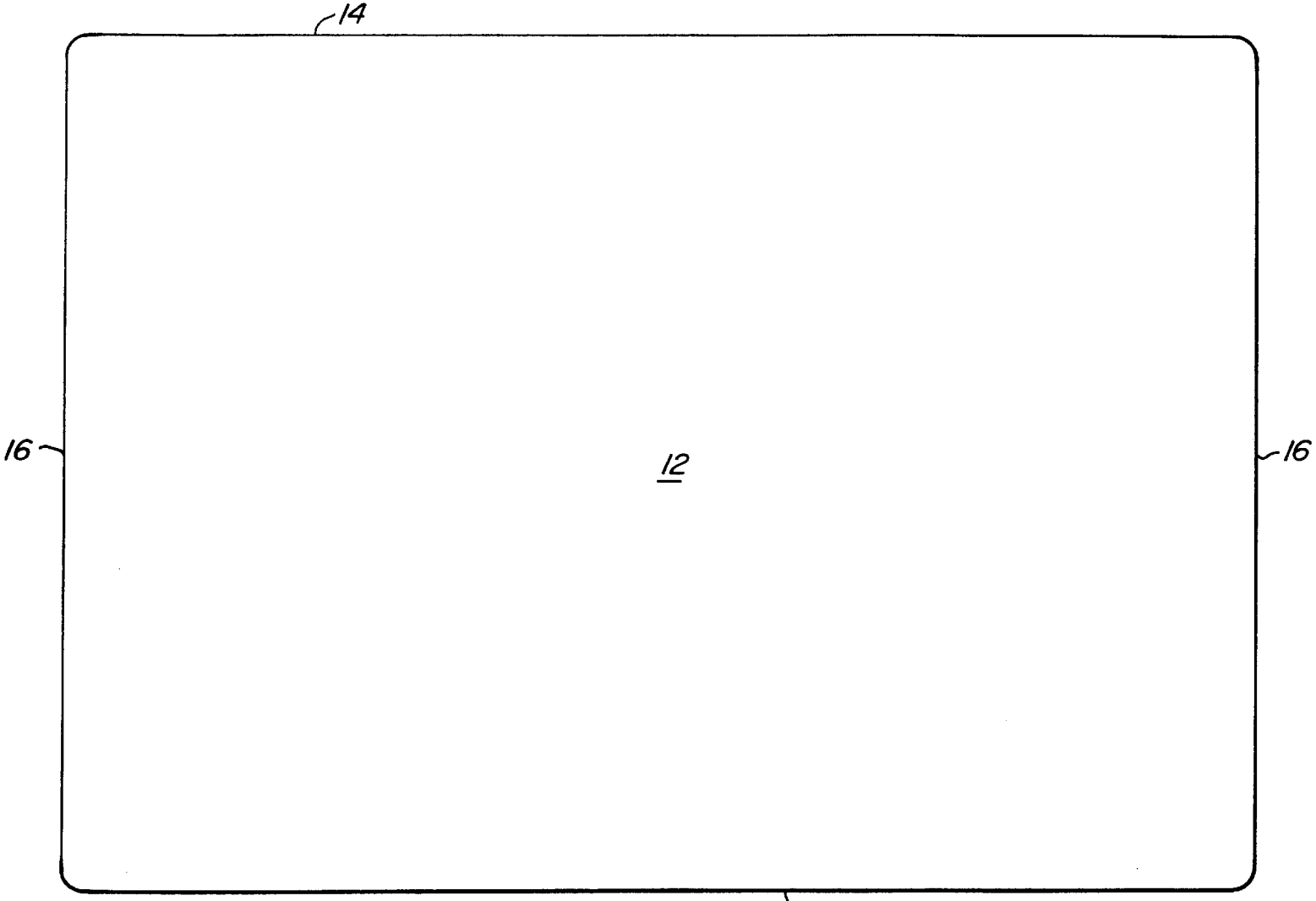
FIG. 4 is a bottom plan view of the expandable hollow gasoline container of FIG. 1.

An expandable orifice member, generally illustrated as 30, extends through one of the side walls 14 and provides an outlet for gasoline from inside of the expandable, hollow container 10. The top 18 includes a vent opening 34 (see FIG. 1) and an opening 38 generally centrally disposed in the top 18. A cylindrical conduit, generally illustrated as 40, is axially aligned with the opening 38 and is mounted to the top 18 such as to be capable of receiving gasoline there through to fill the expandable container 10. A handle assembly, generally illustrated as 44, is engaged to the conduit 40 such as to be generally parallel to the generally planar top 18 (see FIGS. 2 and 3) and generally supported by same in the parallel relationship.

Figure 13:
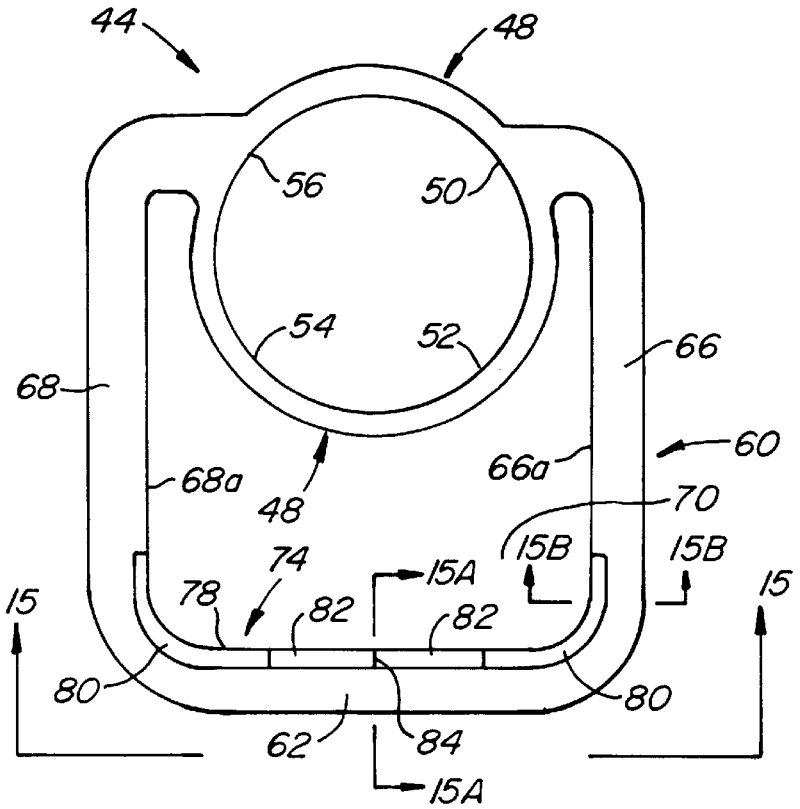
FIG. 13 is a top plan view of the handle assembly.
Figure 14:
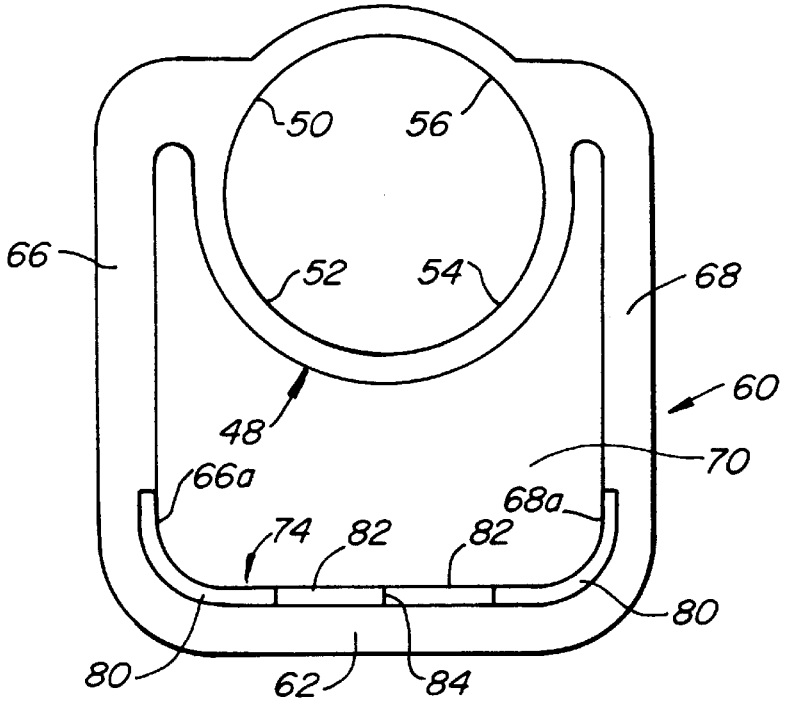
FIG. 14 is a bottom plan view of the handle assembly of FIG. 13.
Figure 15:
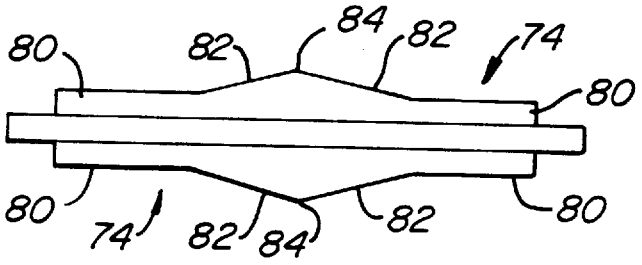
FIG. 15 is an end elevational view taken in direction of the arrows and along the plane of line 15—15 in FIG. 13.
Figure 15A:
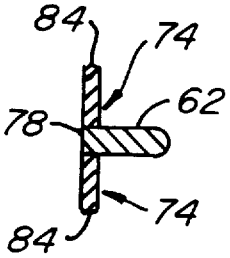
FIG. 15A is a vertical sectional view taken in direction of the arrows and along the plane of line 15A—15A in FIG. 13.
Figure 15B:
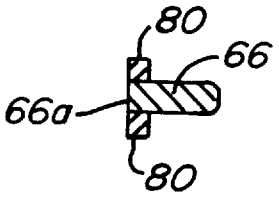
FIG. 15B is a vertical sectional view taken in direction of the arrows and along the plane of line 15B—15B in FIG. 13.

The handle assembly 44 includes a ring member 48 with quadrant sections 50, 52, 54 and 56. The handle assembly 44 also includes a generally U-shaped handle 60 consisting of a grasping rod or member 62 and a pair of arms 66 and 68 integrally bound to the grasping member 62 and respectively secured to quadrant sections 50 and 56 of the ring member 48 member to form an opening 70 where through a person's fingers may pass to carry the container 10. The handle 60 has a pair of ridges, which are generally illustrated as 74 (see FIGS. 13–15). The ridges 74—74 extend along an internal boundary 78 (see FIG. 15A) of the grasping member 62 and along a portion of internal boundaries 66*a* and 68*a* of arms 66 and 68 respectively (e.g. see FIG. 15B). Each ridge 74 consists of a pair of lower ridge sections 80—80 and a pair of sloping ridge sections 82—82 that extend from the lower ridge sections 80—80 and terminate in a ridge apex 84. The arms 66 and the ring member 48 all lie in a plane horizontal to top 18 with the lowermost ridge apex 84 being supported by or capable of being supported by the top 18. As will be further indicated below, the ring member 48 lodges in a cylindrical or circular groove (identified as "96" below) of the cylindrical conduit 40.

Figure 8:
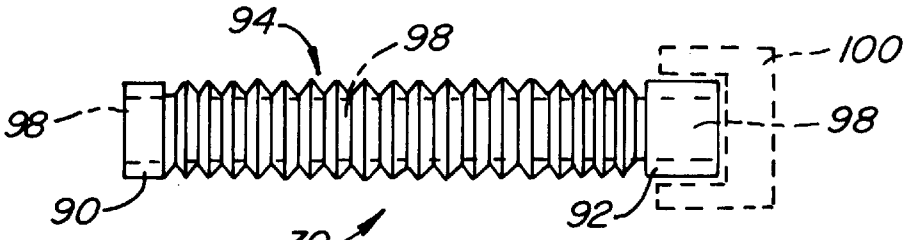
FIG. 8 is a side elevational view of the orifice member in an expanded state.

The expandable orifice member 30 comprises a cylindrical base 90, a cylindrical end 92, and a hollow accordion pleated, corrugated orifice wall 94 (which may be rectangular or cylindrical) bound to the cylindrical base 90 and to the cylindrical end 92. As best shown in FIG. 8, an orifice bore 98 extends through the cylindrical base 90, the accordion orifice wall 94 and through the cylindrical end 92 to provide a passage from inside of the container 10 to the gas tank of a motor vehicle. An orifice cap 100 (see FIG. 8) may be conveniently disposed to and around the cylindrical end 92 until time that gasoline is to be removed from the container 10. FIG. 8 shows the orifice member 30 in a collapsed or compressed state. FIG. 8 illustrates the orifice member 30 in an expanded state which is employed for pouring gasoline from the container 10.

Figure 9:
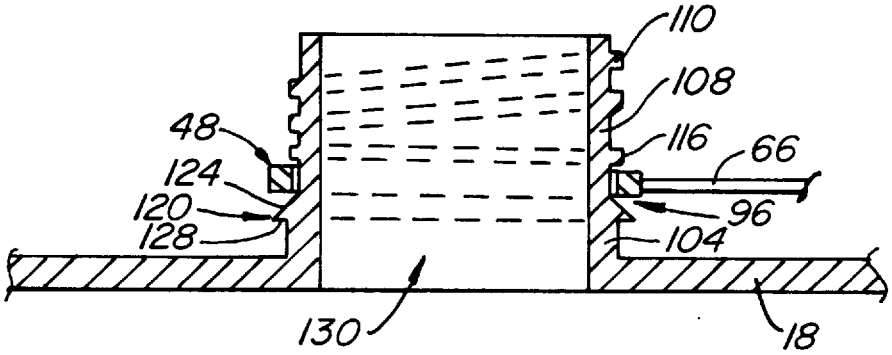
FIG. 9 is a vertical sectional view taken in the direction of the arrows and along the plane of line 9—9 in FIG. 1.
Figure 10:
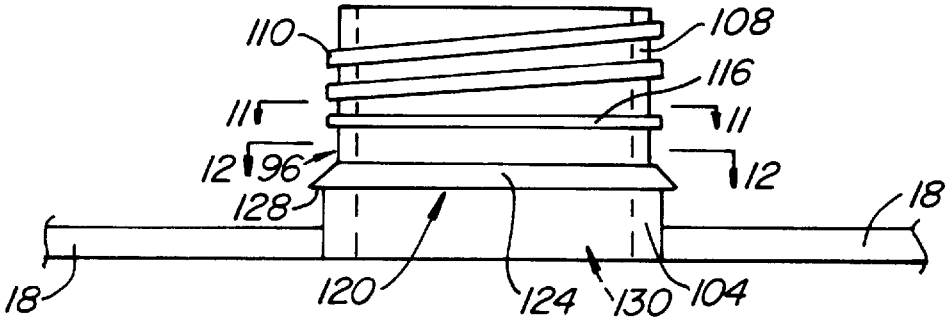
FIG. 10 is a side elevational view of the cylindrical conduit where through gasoline is poured in order to fill the expandable hollow gasoline after the gasoline container has been expanded.
Figure 11:
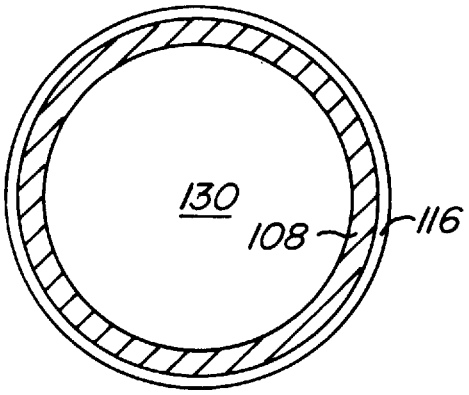
FIG. 11 is a horizontal sectional view taken in direction of the arrows and along the plane of line 11—11 in FIG. 10.
Figure 12:
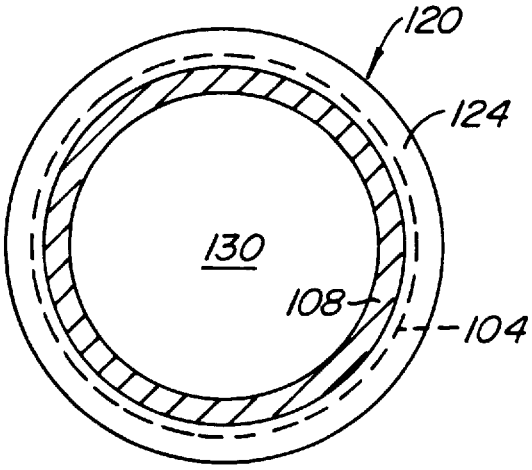
FIG. 12 is a horizontal sectional view taken in direction of the arrows and along the plane of line 12—12 in FIG. 10.

The cylindrical conduit 40 comprises a lower cylindrical hollow neck 104 and an upper cylindrical hollow neck 108 having an outside diameter that is smaller than the outside diameter of the lower cylindrical hollow neck 104. The upper cylindrical hollow neck 108 is formed with screw threads 110 to threadably engage internal threaded closure cap 112 (see FIG. 3). The upper cylindrical hollow neck 108 is also formed with a circular ridge or ring 116 and terminates in a skirt 120 that is spaced from the ring 116 to define a cylindrical or circular groove 96 there between. The ring member 48 (see FIG. 9) of the handle assembly 44 rotatably and affixedly lodges within groove 96. The skirt 120 is defined by a sloping skirt surface 124 and a flanged surface 128 extending and flanging outwardly from the lower cylindrical hollow neck 104. A bore 130 extends through the lower and upper necks 104 and 108 respectively for providing a passage where through gasoline passes after the container 10 is expanded and when the container 10 is being filled with gasoline.

It will be noted that the container 10 is substantially in a rectangular shape which has been found to be the preferred shape which provides the greatest volume for the purpose of the container 10. However, an exact rectangular shape is not absolutely essential.

The container 10 is preferably formed of a flexible thermoplastic material such as, for example only, polyethylene which as is known has an unusual combination of properties including freedom from taste, odor, toxicity; flexibility at extremely low temperatures; low moisture-vapor transmission; resistance to chemicals, solvents, greases; and good characteristics from the tensile, impact and other physical points of view. Manifestly thermoplastic materials such as vinyls, acetates and styrenes, and others can be utilized. Additionally, if desired a rigid plastic can be used which will still maintain the advantage of light weight. Also and although not necessary, the planar base 12 and the planar top 18 may be made slightly more rigid than the pleated walls 20—20 and 22—22 to help retain the shape of the container 10. A slightly more rigid base 12 and top 18 also helps a user in expanding the container 10 since the base 12 and top 18 are typically hand held by the user in the expanding process.

A customer may purchase the container 10 of the present invention, and store it in a glove compartment (or trunk) of a car, and use it as needed. Once the gasoline container 10 has been used as desired, it should be disposed of according to directions on the container 10 Preferably, a used gasoline container 10 should be taken to a hazardous waste center for proper disposal.

Figure 5:
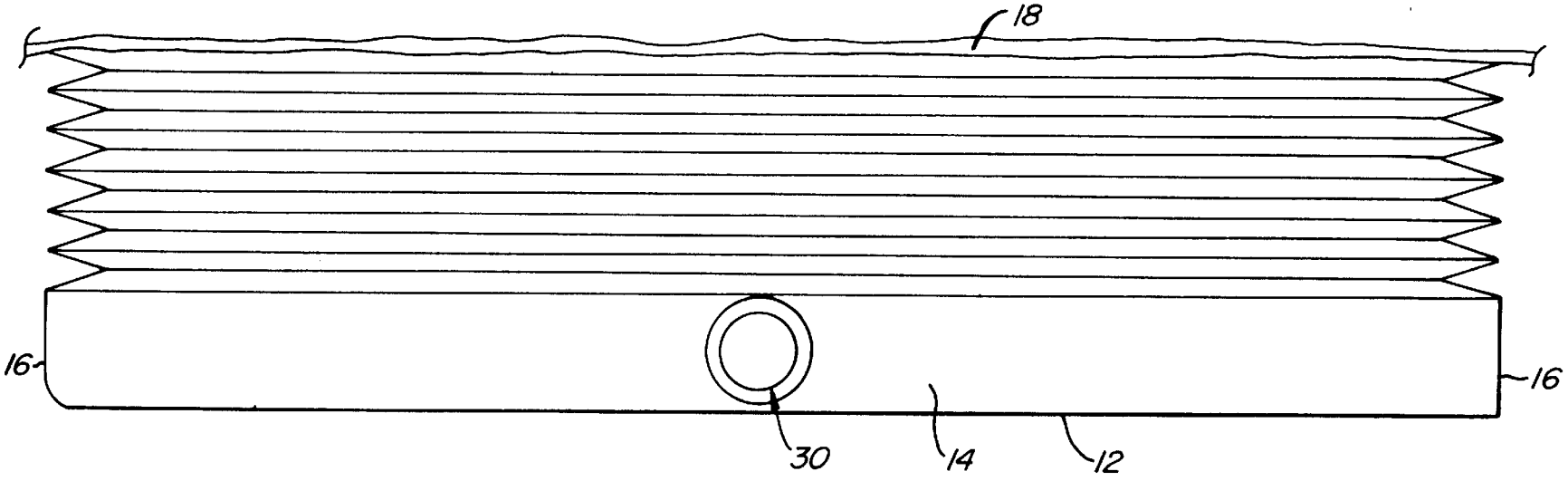
FIG. 5 is a partial side elevational view of the hollow gasoline container of FIG. 1, but in a compressed state.
Figure 6:
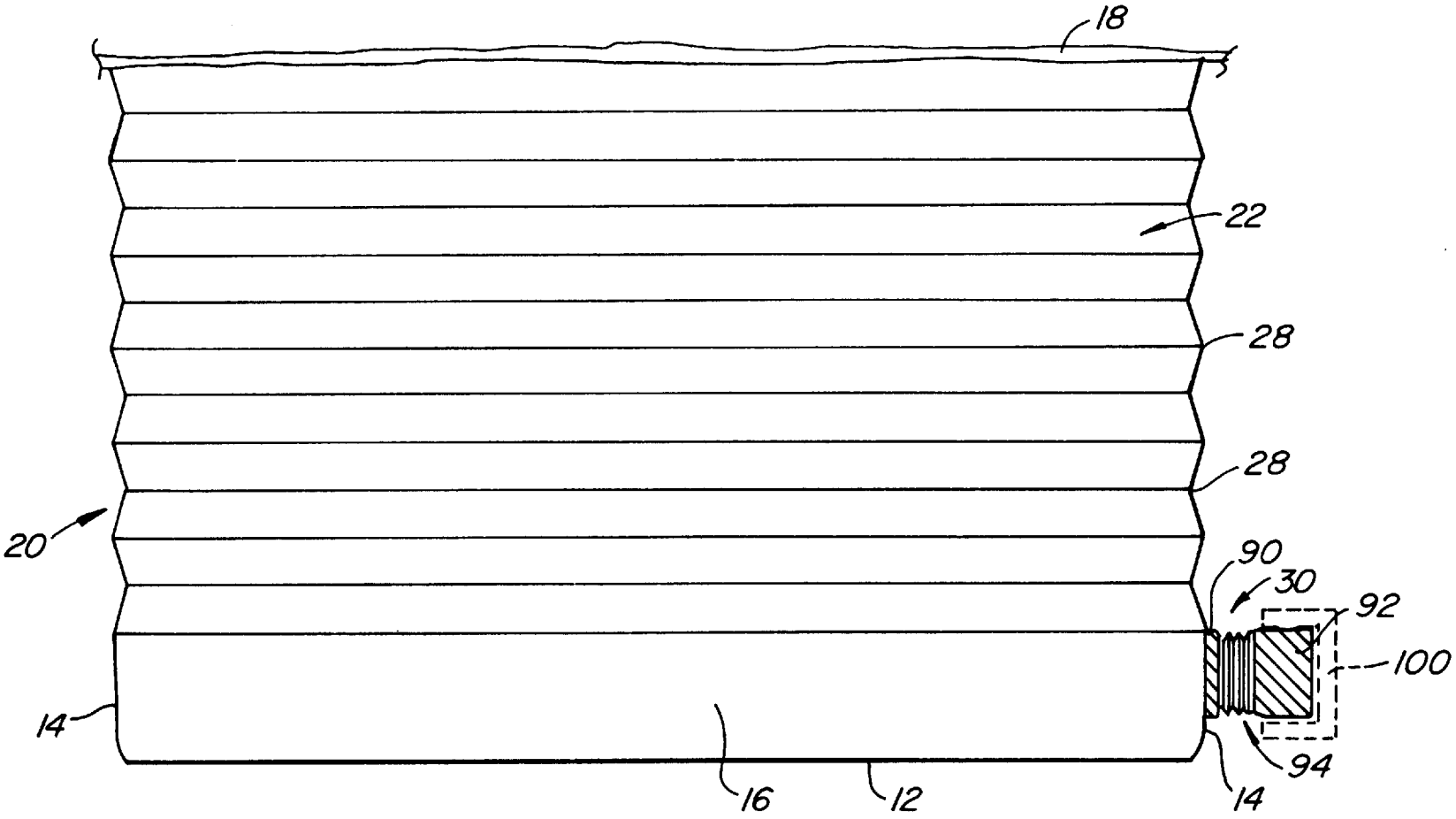
FIG. 6 is a partial end elevational view of the expandable hollow gasoline container of FIG. 1, including the orifice member in a compressed state.
Figure 7:
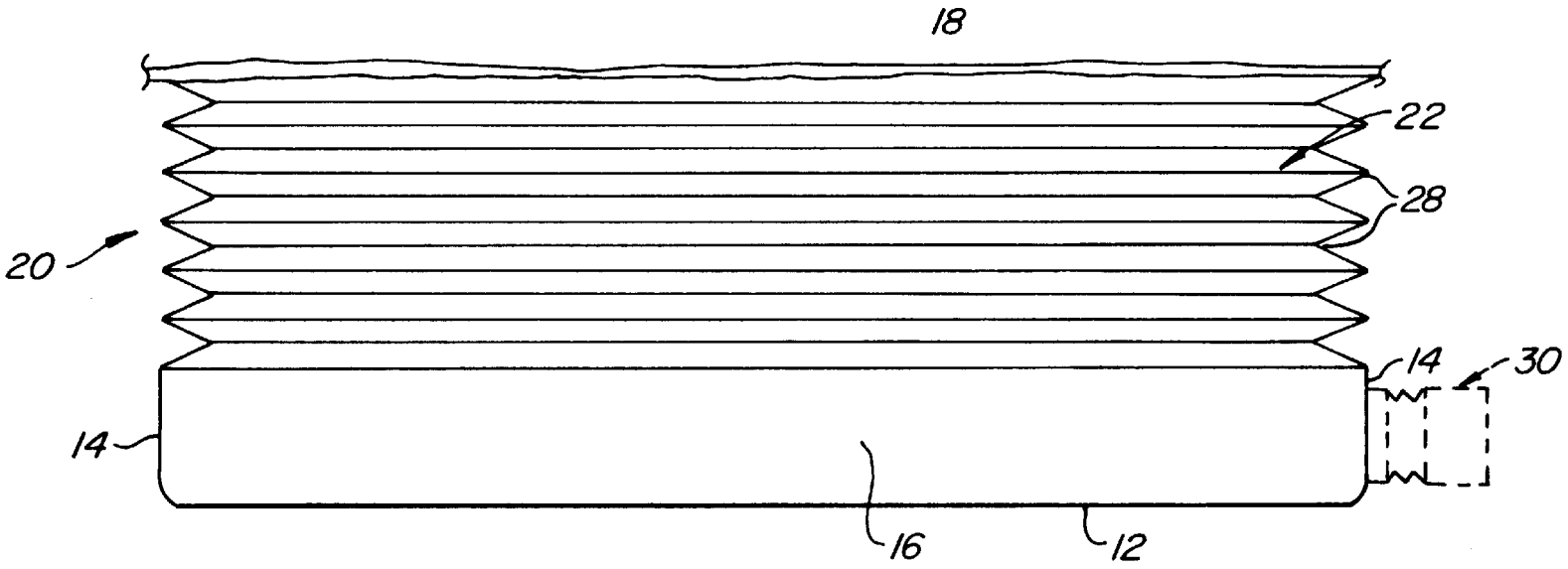
FIG. 7 is a partial end elevational view of the gasoline container of FIG. 1, but in a compressed state and with the orifice member illustrated in a dotted line representation.

Continuing to refer to the drawings for operation of the invention and the method for adding gasoline to a gasoline tank of a motor vehicle, the gasoline container 10 in a compressed state (see FIGS. 5–7) is disposed in a glove compartment of a motor vehicle. When the motor vehicle runs out of gasoline, the compressed gasoline container 10 is removed from the glove compartment and is subsequently expanded by grasping the top 18 in one hand and grasping the base 12 or any the of the walls (e.g. walls 14—14) associated with the base 12 in the other hand and pulling the grasped sections apart or away from each other. The expanded container 10 is then carried to a gasoline pump. Closure cap 112 is removed from the cylindrical conduit 40 (i.e. from the upper cylindrical hollow neck 108 of the cylindrical conduit 40). Gasoline is pumped into the expanded gasoline container 10 through the cylindrical conduit 40. After the gasoline container 10 contains the desired quantity of gasoline, the closure cap 112 is threadably secured to and around the cylindrical conduit 40 and the gasoline-contained container 10 is carried back to the motor vehicle. The cylindrical end 92 of the orifice member 30 is grasped and pulled away from the gasoline-contained container 10 to expand the orifice member 30 into the expanded state as represented in FIG. 8. After the expanded orifice member 30 is aligned with the gas conduit (not shown) that communicates with the gas tank of the motor vehicle, the orifice cap 100 is removed and gasoline commences to pour or flow from the gasoline-contained container 10, through the expanded orifice member 30 and into the gas tank of the motor vehicle. The gasoline container 10 may be discarded after all of the gasoline has been poured therefrom. Preferably and as previously indicated, the container 10 should be disposed at a hazardous waste center.

The invention will be illustrated by the following set forth example which is given by way of illustration to set forth the currently known best mode and not by way of any limitation. All parameters such as capacitor values, charged voltages, times, etc. submitted in this example are not to be construed to unduly limit the scope of the invention.

We claim:

1. An expandable gasoline container comprising a generally planar base; a pair of generally upright base sidewalls bound to the base; a pair of generally upright base end walls secured to the base and to the generally upright base sidewalls; a generally planar top having a vent opening and a generally central opening; a pair of accordion pleated sidewalls secured to the top and to the generally upright base sidewalls; a pair of accordion pleated end walls secured to the accordion pleated sidewalls and to the generally upright base end walls and to the top; an expandable orifice member secured to and extending through one of the generally upright base sidewalls; a cylindrical conduit connected to the top and axially aligned with the generally central opening; and a handle assembly engaged to the cylindrical conduit, said cylindrical conduit includes a conduit structure defining conduit threads, a circular ridge disposed above said generally planar top, and a conduit skirt disposed above said generally planar top and spaced from the circular ridge to provide a circular groove wherein part of the handle assembly rotatably lodges.

2. The expandable gasoline container of claim 1 wherein the cylindrical conduit also includes a conduit structure defining a lower cylindrical hollow neck having an outside diameter and secured to the top and terminating in the conduit skirt; and an upper cylindrical hollow neck having the conduit threads and the circular ridge and terminating in the conduit skirt and including an outside diameter less than the outside diameter of the lower cylindrical hollow neck.

3. The expandable gasoline container of claim 2 wherein said handle assembly comprises a handle ring member and a generally U-shaped handle having a grasping section and a pair of handle arms bound to the grasping section and to the handle ring member; said handle ring member rotatably lodging in said circular groove.

4. The expandable gasoline container of claim 3 wherein said handle ring member and said generally U-shaped handle are generally parallel to said generally planar top.

5. The expandable gasoline container of claim 4 wherein said ridge member includes a pair of lower ridge sections and a pair of sloping ridge sections extending from the pair of lower ridge sections and terminating in a ridge apex.

6. The expandable gasoline container of claim 5 wherein said ridge member includes a pair of lower ridge sections and a pair of sloping ridge sections extending from the pair of lower ridge sections and terminating in a ridge apex.

7. The expandable gasoline container of claim 6 wherein said ridge apex is capable of contacting and being supported by said generally planar top.

8. The expandable gasoline container of claim 7 wherein said expandable orifice member comprises a cylindrical orifice member comprising a cylindrical base secured to one of said base side walls; a cylindrical end; and a hollow accordion pleated orifice wall bound to the cylindrical base and to the cylindrical end.

9. The expandable gasoline container of claim 6 wherein said ridge apex is supported by said generally planar top.

10. The expandable gasoline container of claim 9 wherein said expandable orifice member comprises a cylindrical orifice member comprising a cylindrical base secured to one of said base side walls; a cylindrical end; and a hollow accordion pleated orifice wall bound to the cylindrical base and to the cylindrical end.

11. The expandable gasoline container of claim 1 wherein said expandable orifice member comprises a cylindrical orifice member comprising a cylindrical base secured to one of said base side walls; a cylindrical end; and a hollow accordion pleated orifice wall bound to the cylindrical base and to the cylindrical end.

12. The expandable gasoline container of claim 1 wherein said handle assembly comprises a handle ring member and a generally U-shaped handle having a grasping section and a pair of handle arms bound to the grasping section and to the handle ring member.

13. The expandable gasoline container of claim 12 additionally comprising at least one ridge member bound to said grasping section.

14. The expandable gasoline container of claim 13 wherein said ridge member includes a pair of lower ridge sections and a pair of sloping ridge sections extending from the pair of lower ridge sections and terminating in a ridge apex.

15. The expandable gasoline container of claim 12 wherein said handle ring member and said generally U-shaped handle are generally parallel to said generally planar top.

16. A method for adding gasoline to a gasoline tank of a motor vehicle comprising the steps of:

(a) providing a motor vehicle having a compartment and a gas tank;

(b) disposing an expandable hollow gasoline container in said compartment, said expandable gasoline container comprising a generally planar base, a generally planar top, a cylindrical conduit connected to the generally planar top, accordion pleated walls coupled to said planar base and to said planar top, and a compressed orifice assembly for pouring gasoline from said gasoline container, said cylindrical conduit includes a conduit structure defining conduit threads, a circular ridge disposed above said generally planar top, and a conduit skirt disposed above said generally planar top and spaced from the circular ridge to provide a circular groove wherein part of the handle assembly rotatable lodges;

(c) removing the gasoline container from the compartment of step (b);

(d) expanding the removed gasoline container;

(e) adding gasoline into the expanded gasoline container;

(f) expanding the orifice assembly; and (g) pouring gasoline from the gasoline container, through the expanded orifice assembly and into the gas tank of a motor vehicle.

17. The method of claim 16 wherein said compartment is a glove compartment.

18. The method of claim 16 wherein said compartment is a trunk of the motor vehicle.

19. The method of claim 16 additionally comprising disposing of the container.

20. The method of claim 16 additionally comprising depositing to container with a hazardous waste center.

* * * * *